United States Patent [19]

Black

[11] Patent Number: 4,912,442

[45] Date of Patent: Mar. 27, 1990

[54] SCANNED ELECTROMECHANICAL ALPHANUMERIC DISPLAY

[76] Inventor: Fred M. Black, 109 Kemp Rd. East, Greensboro, N.C. 27410

[21] Appl. No.: 134,519

[22] Filed: Dec. 17, 1987

[51] Int. Cl.[4] ..... G08B 5/00

[52] U.S. Cl. ..... 340/764; 340/783; 40/473; 40/505

[58] Field of Search ..... 340/783, 815.24, 815.26, 340/815.27, 815.24, 764; 40/423, 447, 449, 466, 497, 492, 473, 475, 530, 531, 532, 533

[56] References Cited

U.S. PATENT DOCUMENTS

| | | | |
|---|---|---|---|
| 3,003,268 | 10/1961 | Chan | 40/473 |
| 3,267,595 | 8/1966 | Levy et al. | 340/764 |
| 3,975,728 | 8/1976 | Winrow . | |
| 3,983,648 | 10/1976 | Hunter | 40/473 |
| 4,091,382 | 5/1978 | Anderson et al. . | |
| 4,161,832 | 7/1979 | Bergamini | 40/466 |
| 4,177,458 | 12/1979 | Wakatake | 340/764 |
| 4,264,906 | 4/1981 | Wakatake | 340/764 |
| 4,389,804 | 6/1983 | Seibert et al. | 40/447 |
| 4,417,241 | 11/1983 | Wakatake | 340/764 |
| 4,566,003 | 1/1986 | Wakatake | 340/764 |
| 4,615,131 | 10/1986 | Wakatake | 340/764 |
| 4,616,222 | 10/1986 | Wood | 340/815.24 |

*Primary Examiner*—Alvin Oberley
*Attorney, Agent, or Firm*—Kenneth Watov

[57] ABSTRACT

A display apparatus comprises a plurality of rotationally mounted display elements arranged into a matrix of rows and columns, the axes of rotation of said display elements being perpendicular to each associated column and parallel to each associated row, respectively, said display elements each including first and second display faces perpendicular to one another and joined along respective adjacent edges, for providing a desired arrangement of said display faces at the front of said display apparatus; first and second ramp surfaces are rigidly connected along inside edges of and extending substantially perpendicularly away from a back surface of said first and second faces, respectively, opposite the edges joining said first and second display faces, respectively; and an actuator assembly is mounted for bidirectional movement along a path perpendicular to the planes of rotation of said display elements at the rear of said display apparatus, for stroking selected ones of said first and second ramp surfaces with sufficient force to cause the associated display elements to rotate 90° for changing the pattern of associated first and second faces at the first of the display.

34 Claims, 15 Drawing Sheets

SCANNED ELECTROMECHANICAL ALPHANUMERIC DISPLAY

RELATED APPLICATION

The present invention is related to the invention of Ser. No. 913,536, entitled "Scanned Electromechanical Display", filed on Sept. 30, 1986, U.S. Pat. No. 4,761,905. The patentee of this copending application is the same as the present patentee.

FIELD OF THE INVENTION

The present invention relates generally to a sign for displaying alphanumeric and/or graphical information, and more particularly relates to a matrix of columns and rows of like display elements that can be remotely changed from on display state to another, for changing the display from one arrangement of the elements to another.

BACKGROUND OF THE INVENTION

Many different types of mechanical, electromechanical, and electronic display devices are known and have been developed over the years in the field of the present technology.

In Levy, et al U.S. Pat. No. 3,267,595, a display unit is disclosed that can be provided with a plurality of different types of display elements and triggering mechanisms for moving the display elements to change the display. In one embodiment, Levy, et al includes a moving belt of rows and columns of rotatable rectangular-lie display elements, whereby for each row of display elements, a solenoid-operated trigger finger is selectively activated for flipping over (rotating by 180°) selective ones of the elements for changing the information being displayed. A mechanical cam mechanism 24 (see FIG. 6) is used to hold a given display element 23 in appropriate alignment in the display for displaying information through appropriate positioning of the various ones of the elements 23 in the matrix. In FIG. 8, a control system is shown for controlling selective activation of the various electromagnetic triggers for selectively flipping the display elements 23. In another embodiment, triangular display elements are shown in FIG. 9 for providing three-faced elements, nd are used in combination with a pair of solenoid operated trigger pins to rotate selected ones of the triangles from one display position to another. Four-faced display elements 60, as shown in FIG. 11, represent another embodiment which requires three solenoid-operated "triggers" for selectively rotating a given four-faced element or block, and three "reset fingers" are required for resetting the elements. Each element of Levy's four-faced elements appear to be cube-like, and to have four unique faces. Also, Levy rotates the belt of display elements past stationery solenoid-operated triggers for changing the elements rotational orientation, to change a given display. Another embodiment of Levy, et al (see FIG. 26) shows a fixed matrix of display elements 160, with a carriage mechanism provided at the back of the display 160, for moving a plurality of solenoid-operated fingers back and forth across the back of the display element, for selectively flipping various ones of the display elements 180' for providing a desired display on the front of the display unit. As shown in FIG. 27, the elements 161 each include two lugs for providing automatic resetting, whereby when a given one of the lugs 175 or 176 contact an arm 171 of a solenoid 172, the element is flipped 180° to change the face of the element being presented on the display side of the display unit.

In Anderson et al, U.S. Pat. No. 4,091,382, a display system is disclosed that is made up of a plurality of display units each including a thin, pivotally-mounted vane 20 movable by electrostatic forces between upright and horizontal positions, for selectively providing a desired display. Also, in Winrow U.S. Pat. No. 3,975,728, an electromagnetic display is taught that includes a plurality of display elements each including a disc that is pivotally mounted on an axis parallel to the mean plane of the display, whereby electromagnetic means are used to rotate the disc for providing a desired display.

In Bergamini U.S. Pat. No. 4,161,832, an electromechanical digital indicator for displaying numerical information is disclosed, in which angular movements of seven movable segments are combined with the action of a block in the shape of an eight and made of a transparent and light-channeling plastic material, to display selected figures from zero to nine in solid lines rather than in segmented form. Fluorescent layers on the bottom wall of the block are included for displaying the numerals under conditions of either direct or indirect lighting, or in darkness. Also, internal illumination can be provided on the interior portion of the indicator box.

In Wakatake U.S. Pat. No. 4,177,458 a display panel, is shown to include a plurality of display elements that are rotatable in a vertical plane. The elements are formed from plate-like or four-cornered block members having two or four display surfaces of different colors and include one or three magnetic pieces, respectively. Up to three electromagnets are energized for permitting the selection of a particular face of a given display element by rotation to the display side of the display panel. In this manner, a desired pattern can be displayed. In a later Wakatake U.S. Pat. No. 4,264,906, similar display elements are shown that have display surfaces of different colors, providing displays of desired characters or patterns in the display side of the display panel.

In Siebert, et al U.S. Pat. No. 4,389,804, a matrix of individually activated flip discs are provided for a display. Magnetic forces are utilized with each disc for moving the associated disc between a reflective position exposing one disc surface at the front of the panel, to a closed condition exposing an opposite surface at the front of the panel, and lastly to an intermediate position permitting backlighting.

In Wakatake U.S. Pat. No. 4,417,241, a display panel is disclosed consisting of a matrix of rotatable block-like members each having up to four different display surfaces. Each block member has a plurality of magnetic pieces attached to it for selective coaction with electromagnets mounted on a movable carriage mechanism, for providing selective positioning of each display element to form a desired pattern on the front of the display panel.

In Wakatake U.S. Pat. No. 4,566,003, a plurality of display elements are formed into a drum-like display panel, wherein each of the elements consists of a four-sided right prismatic block member which is rotatable about its own central axis. Two stable states are provided for each one of the display elements. Permanent magnets are attached to each one of the block members for coaction with a stationary electromagnetic actuator system about which the display elements or blocks revolve. The electromagnetic triggering mechanism is selectively activated for rotating the display elements to a desired position.

In Wakatake U.S. Pat. No. 4,615,131, a matrix of rotatable block-like display elements is disclosed for providing a display panel. Each of the display elements has a permanent magnet type motor associated with that element, which motor is activated for positioning a particular face of the block at the front of the display for permitting a desired pattern to be displayed by selective positioning of each block.

Wood U.S. Pat. No. 4,616,222 teaches a system for providing a display that consists of a plurality of rotatable display elements each consisting of relatively thin rectangular-like elements. Each element is generally planar. Electromagnetic solenoids associated with each of the display elements, respectively, are selectively activated to rotate associated elements 180°, for obtaining a desired pattern on the surface of the display.

SUMMARY OF THE INVENTION

In a preferred embodiment of the invention, a display apparatus comprises a matrix of rows and columns of individually movable display elements, each element having two distinct display faces perpendicular to each other, with ramp means rigidly connected to the inside edges of each face opposite the edges where the faces are joined together, each ramp means extending substantially perpendicularly away from each associated face of said display element, a ramp means of each non-displayed face being substantially parallel to and in juxtaposition to the plane of travel of a carriage assembly upon which are mounted selectively movable actuator means, for providing as the carriage is moved behind the display panel selective engagement of an actuator means with particular ones of the ramp means for causing 90° rotation of the associated display elements in a plane of rotation perpendicular to the plane of movement of the carriage assembly, for selectively positioning either one or the other of the display faces of the display elements at the front of the display for obtaining a desired pattern for display.

BRIEF DESCRIPTION OF THE DRAWINGS

In the drawings, wherein like items are indicated by the same reference number.

DESCRIPTION OF THE PREFERRED EMBODIMENTS OF THE INVENTION

Figure 1:
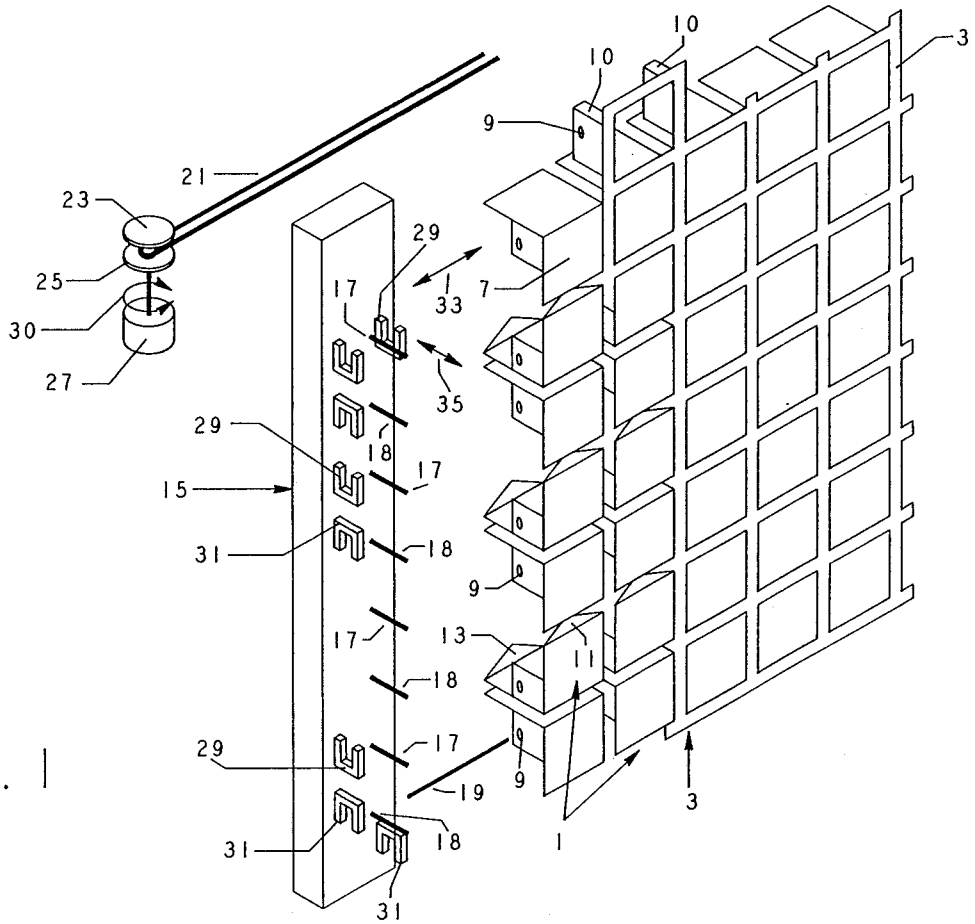
FIG. 1 is a fragmented cutaway pictorial diagram of one embodiment of the invention.

With reference to FIG. 1, a fragmented pictorial view of one embodiment of the present display apparatus is shown. A plurality of display elements 1 are arranged in a matrix of rows and columns within a frame 3, as shown. Each of the display elements 1 have two unique faces, identified for purposes of illustration as an upper face 5, and a lower face 7. The typically unique faces 5,7 are perpendicular to one another, and at any given time only one of these faces 5 or 7 will be displayed via selective orientation of the associated display element 1. The elements 1 are mounted for rotation about a pivot point 9. The pivot point or pivot shaft 9 is mounted between support walls 10 associated with each display element 1. The support walls 10 are integrally related to the frame 3, and are rigidly mounted to the back of frame 3 as shown. At least one row of element position sensors 29 are provided on one side of each one of the upper and lower face actuators 17,18, respectively.

In the embodiment of the invention shown, each upper element face 5, and lower element face 7, have ramps 11 and 13 projecting away from their inner edges, respectively, as shown in this example. An actuator assembly or carriage 15 includes a plurality of pairs of actuators (17,18) consisting of an upper face actuator 17, and a lower face actuator 18. The carriage 15 is mounted at its lower end for movement along a guide track 19, and at its upper end is rigidly connected to a drive belt 21. The drive belt 21 is connected to a pulley 23, the latter being connected to an end of drive shaft 25 of a drive motor 27.

At least one row of element position sensors 29,31 are provided on one side of each one of the upper and lower face actuators 17,18, respectively. In a preferred embodiment of the invention, a second column of sensors 29,31, are also provided on the other side of the actuators 17 and 18, respectively, as shown. Note that sensors 29 and 31 are rotated 180° from one another, for detecting ramps 11 and 13, respectively.

A general description of the operation of the present display apparatus will now be described. The motor 27 is operated to provide appropriate clockwise or counterclockwise movement of drive shaft 25 (see arrow 30), for moving drive belt 21 to move carriage 15 back and forth behind the matrix of display elements 1 as indicated by arrow 33. A position of the carriage or actuator assembly 15 at any given time is detected via position detecting means (not shown) to be described in greater detail below. Selective ones of the actuators 17 and 18 are actuated for contacting an upper face ramp 11 or lower face ramp 13, respectively, of given ones of the display elements 1 behind which the carriage 15 is moving at the time, for moving the associated display element 1 90° about its associated pivot point or shaft 9 for displaying a desired face 5 or 7 of the associated display element 1. More particularly, assume a given display element 1 is positioned to display its upper face 5, and it is desired to rotate the element 1 to display its lower face 7. As the carriage 15 moves into the immediate vicinity of the associated element 1, the associated lower face actuator 18 for that row of elements 1 is actuated to move the actuator 18 outward from the carriage 15 for intercepting the ramp 13 of the element 1, causing the element 1 to rotate in a counterclockwise direction, for displaying its lower face 7. Similarly, upper face actuators 17 are selectively actuated or moved away from the carriage 15 for engaging upper face ramps 11 of selected ones of the elements 1, as carriage 15 moves, for causing these elements 1 to rotate in a clockwise direction to display their associated upper face 5 (assuming their associated lower face 7 was previously being displayed). Note that in this illustration, the clockwise and counterclockwise rotation of the elements 1 is with reference to or as viewed from the left sides of the elements 1 as viewed from the front of the display apparatus. Also, note that the actuators 17 and 18 are moved in and out from the carriage 15 as indicated by the arrow 35.

In one embodiment of the invention, a sensor 29 is located on only one side of each one of the actuators 17, for providing sensing of associated elements 1 in only one direction of movement of the carriage 15. Contrariwise, a sensor 29 can be located on the other side of each one of the actuators 18 for providing display element 1 position sensing for the opposite direction of movement of the carriage 15. If bidirectional sensing of the position of the display elements 1 is desired, a second embodiment of the invention includes placement of sensors 29 and 31 to either side of either the actuators 17 or the actuators 18, permitting sensing of the position of display elements 1 regardless of the direction of movement of the carriage 15. In yet another embodiment, a sensor 29 is positioned to one side of each one of the actuators 17 and 18, and sensors 31 to the other side of each one of the actuators 17 and 18. In this latter embodiment, to provide failsafe sensing, each actuator pair 17,18 and the two associated vertical sensors 29, or 31, provide identical signals as the particular associated element 1 is being passed, for indicating a broken or jammed element 1, or a faulty sensor 29 or 31.

Figure 2A:
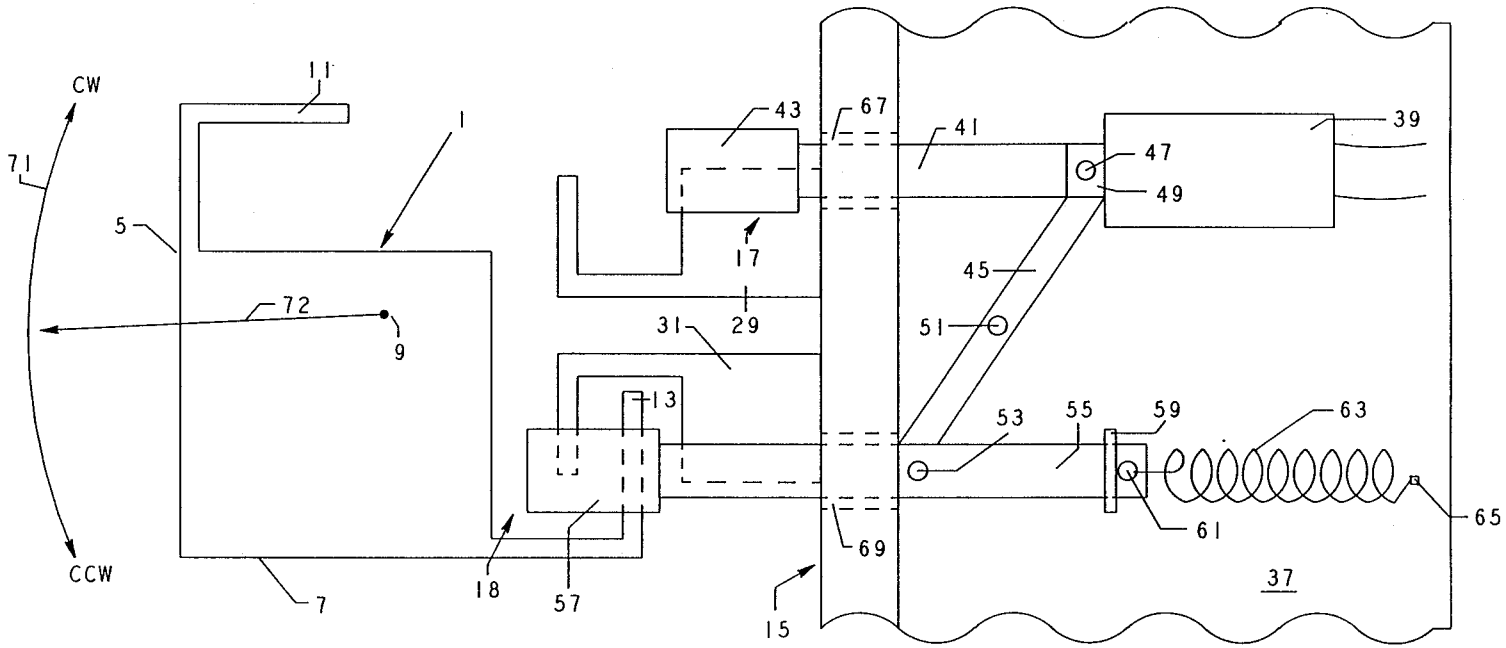
FIG. 2A shows a diagram of an actuator assembly of one embodiment of the invention.

In FIG. 2A, an actuator assembly 37 of one embodiment of the invention is shown, with solenoid 39 in an energized state. When solenoid 39 is de-energized, spring 63 contracts, pulling a lower push rod 55 toward the carriage 15. As will be explained in greater detail below, this causes upper push rod 41 to move outward, for positioning a roller 43 of upper face actuator 17 into a pathway that would intercept an upper face ramp 11 of an element 1 presently positioned for displaying its lower face 7. For the element 1 shown in FIG. 2A, since it is shown in a position for displaying its upper face 5, no contact will be made with its upper face 11 by roller 43 as the carriage 15 passes by.

When solenoid 39 is so de-energized, an escapement rod 45, connected at one end via a pin 47, and clevis 49 to the upper push rod 41, is moved about a pivot 51. The upper end of escapement rod 45 moves in the same direction as upper push rod 41, whereas the lower end of escapement rod 45 moves in the opposite direction. Since the lower end of escapement rod 45 is connected via a pivot pin 53 to the lower push rod 55, the lower push rod 55 moves in the opposite direction to the upper push rod 41. When spring 63 contracts to cause the lower face actuator 18 to move toward the carriage 15, the associated roller 57 connected to one end of lower push rod 55 moves out of a path of travel that would intercept lower face ramps 13 of elements 1 displaying associated upper faces 5 at the time. The other end of the lower push rod 55 is connected via a stop ring 59 and pivot pin 61 to the spring 63, which is expanded and placed under expansive tension via the movement of the lower push rod 55, during energization of solenoid 39, as shown in FIG. 2A. The other end of the spring 63 is connected to a stud 65 that is part of the carriage 15. Note also that the pivot pin 51 is rigidly connected to the carriage 15. Also, note that the upper and lower push rods 41,55, respectively, protrude through upper and lower holes 67,69, respectively, of the carriage 15.

When solenoid 39 is energized, the spring 63, assuming it was previously in a contracted state, is expanded by movement of the lower push rod 55 outward from the carriage 15, causing roller 57 of the lower face actuator 18 to move into a path of travel for intercepting upper face ramps 13 of elements 1 presently displaying upper faces 5, as shown. As the lower push rod 55 moves outward, the escapement rod 45 moves in the same direction at its upper end as the upper push rod or solenoid plunger 41, which upon energization of solenoid 39 is toward the solenoid 39 or inward. This is opposite to movement of the lower push rod 55. Such movement causes roller 43 of upper face actuator 17 to move out of a path of travel for intercepting upper face ramps 11 of elements 1 displaying lower faces 7 in the associated row of the display apparatus. This latter positioning is shown in FIG. 2A, with solenoid 39 energized, and the illustrated element 1 positioned for displaying its upper face 5.

Assuming that the carriage 15 is scanning or moving just proximate the region or area of the display element 1, the roller 57 of the lower face actuator 18 will strike the ramp 13 for a sufficient period of time, and with sufficient force, to cause the element 1 to rotate 90° in a clockwise (cw) direction as designated by the arrows 71 (see radius 72) about the pivot point or shaft 9, causing the lower face 7 of the display element 1 to be displayed. As will be described in greater detail below, the display element 1 is either weighted, spring-biased, or weighted and spring-biased, for insuring that the display element 1 moves 90°, and is aligned or detented into a new position for fully displaying its lower face 7.

Similarly, if subsequently the carriage is again moved past the illustrated display element 1 with the solenoid 39 deenergized for causing the roller 43 of the upper face actuator 17 to contact the upper face ramp 11 as the carriage 15 moves past, the display element 1 will then rotate for 90° counterclockwise (see ccw of arrow 71), and detent or remain at a position for fully displaying its upper face 5. Note that each one of the upper face and lower face actuators 17 and 18, in an alternative embodiment can be individually controlled by separate solenoids (not shown) for independent rather than alternate action as provided by the escapement assembly shown. Also, other means of activation such as motors or air cylinders may also be utilized. Note that through selective energization and de-energization of solenoid 39, only one pass of the carriage 15 may be required for setting up a desired pattern of faces 5 and 7 of elements 1 for display.

Figure 2B:
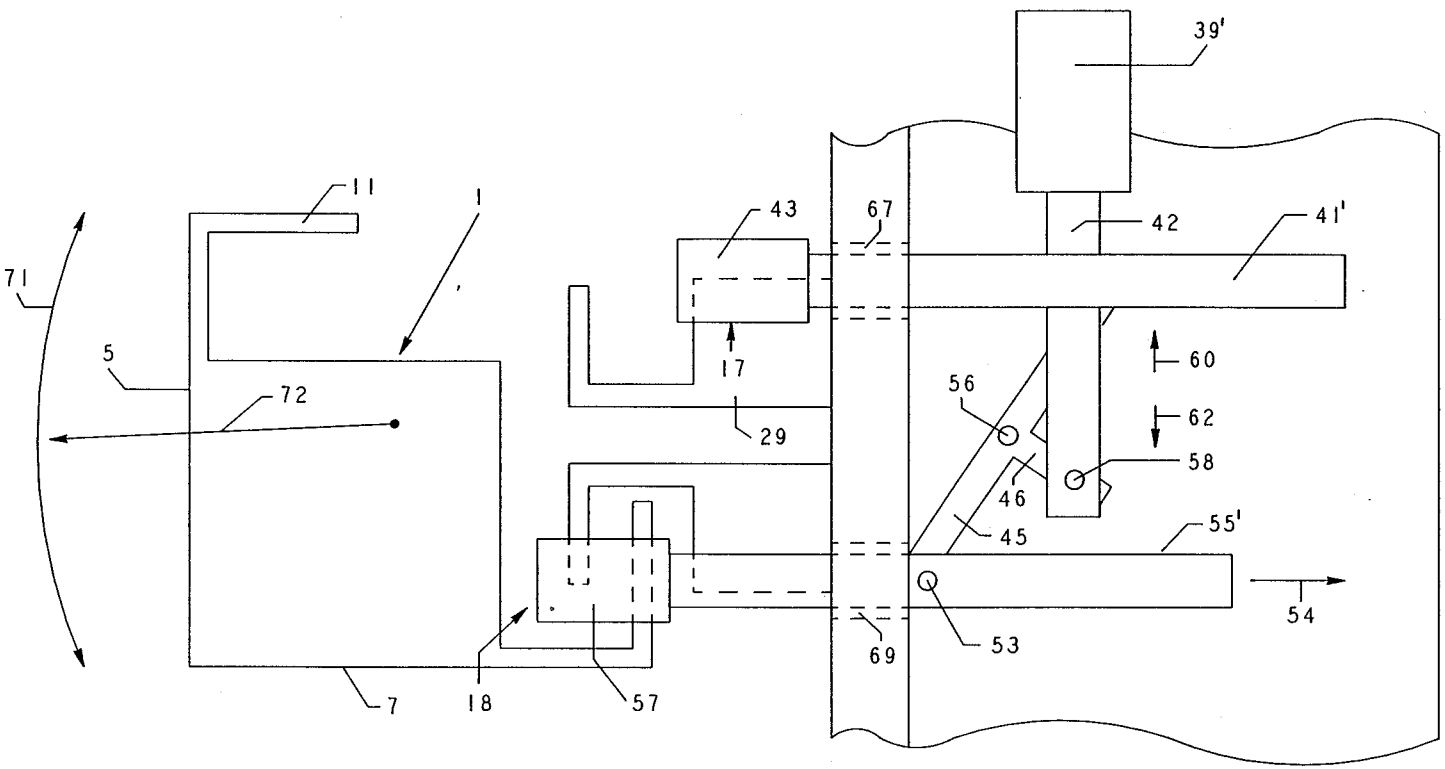
FIG. 2B shows a diagram of an actuator assembly of a preferred embodiment of the invention.

A preferred embodiment of the invention for the actuator assembly is shown in FIG. 2B. As shown, this embodiment incorporates a majority of the design features of the actuator assembly shown in FIG. 2A. In this preferred embodiment, the difference is that the actuating solenoid 39' is mounted vertically and includes a pus rod 42 connected at one end via a pivot pin 58 to a protruding arm 46 of a modified escapement rod 45', relative to the embodiment of FIG. 2B. Also, modified upper and lower push rods 41' and 55' are included as shown. The modified escapement rod 45' is pivotally connected at its ends to the upper and lower push rods 41' and 55', respectively. The weight of the push rod or solenoid plunger 42 must be made large enough to eliminate the requirement for a return spring, such as spring 63 used in the embodiment of FIG. 2A. Under certain operating conditions, such a return spring 63 may be required.

In FIG. 2B, the solenoid 39' is shown in its de-energized state, with the weight of the push rod or solenoid plunger 42 causing this rod or plunger to move downward in the direction of arrow 62 for positioning the upper and lower push rods 41' and 55', respectively, via escapement rod 45', to the positions shown. When solenoid 39' is energized, the solenoid plunger or push rod 42 moves in the direction of arrow 60, causing escapement rod 45' to move lower push rod 55' in the direction of arrow 54, for moving the associated roller 57 out of a path of travel that would intercept lower face ramp 13 of elements 1 displaying associated upper faces 5 at a particular time. Similarly, such movement of the escapement rod 45' also causes upper push rod 41' to move in the opposite direction from arrow 54 for positioning roller 43 into a path of travel for contacting the upper face ramps 11 of display elements 1 displaying lower faces 7 at a particular time. Otherwise, the operation of the actuator assembly is as described for the alternative actuator assembly of FIG. 2A.

Figure 3A:
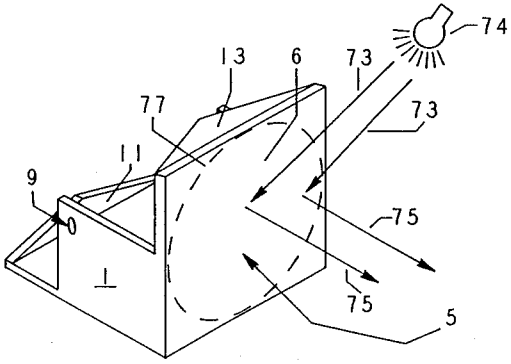
FIG. 3A shows a perspective view of a display element of the invention for providing an opaque face with external lighting, whereby reflective or non-reflective material is used on the display face of a desired shape.

The display elements 1, in one embodiment, provide for external lighting of the display panel of the display apparatus through the use of either reflective (fluorescent) and non-reflective (non-fluorescent) surfaces either individually or in some combination on the faces 5,7 of the element 1. In FIG. 3A, a display element 1 is shown with a rounded or circular reflective area 6 on an upper face 5. External lighting (lightbulb 74, for example) provides incident light rays 73, that bounce off the reflective surface 6 as reflected light rays 75. Note that the reflective surface 6 can be made any desired shape, such as the circular shape shown by the phantom lines 77, in this example. Areas outside of the reflective surface 6 can be made of a non-reflective material, for example.

Figure 3B:
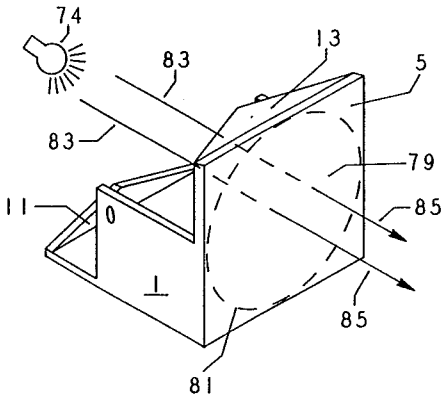
FIG. 3B is a perspective view of an alternative embodiment of a display element of the invention having a transparent or translucent display face adaptable for use with backlighting, with the display face having a desired shape.

In FIG. 3B, display element 1 is shown adapted for use in a back-lit display panel. In this example, the face 5 includes a transparent or translucent area 79 enclosed within the phantom circle 81. A source 74 or sources of light (not shown) are located behind the display panel or display elements 1 in an appropriate manner for providing incident light rays 83 that travel through the transparent or translucent regions 79, as shown, to be transmitted as transmitted light rays 85 to an observer. The regions 79 can be made completely transparent, that is clear, or of a desired color, or if clear the light source 74 can be made a particular color. The other face of the display element 1, in this example the lower face 7, can be made opaque, or can be translucent and of a different color than the region 79 of face 5, or can even be provided with a reflective surface, for permitting various display patterns to be shown on a display panel dependent upon which of the faces 5 or 7 of each of the display elements 1 are being displayed at any given time. Many different combinations of display elements 1 having transparent, translucent, reflective, and opaque faces, for example, can be utilized for providing display panels capable of being operated for the selective display of a variety of different patterns.

Figure 4B:
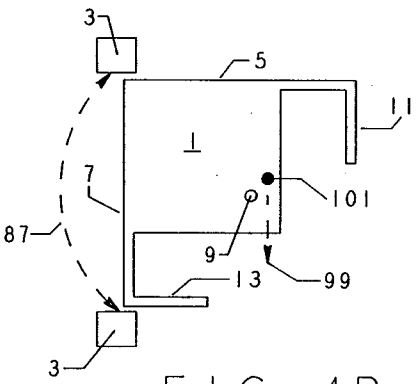
FIG. 4B is a pictorial diagram showing the display element of FIG. 4A after it has been rotated to its second or other stable position for displaying its other face relative to FIG. 4A.
Figure 4A:
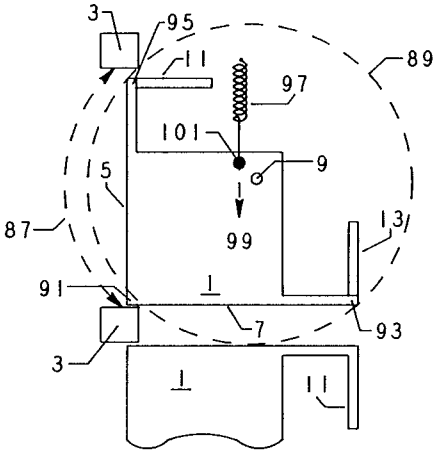
FIG. 4A shows a pictorial diagram of a side view of a display of one embodiment of the invention in one stable position.

In FIG. 4A, a display element 1 is shown with a major axis of rotation 87 and a minor axis of rotation 89. Note that in this example, the corner 91 of the display element 1 is rotated 90° along the major axis 87 between opposite segments of the frame 3, as shown, and does not clear either of these segments 3 during such rotation. The corners 93 and 95 of the display element 1 rotate about the minor radius 89, and do clear the frame 3 during such rotation about the pivot shaft 9. In one embodiment, a compression spring 97 (shown in phantom) is connected between a support wall 10 adjacent the display element 1, and a portion of the display element displaced from the location of the pivot point or shaft 9 associated with the element 1. When rotation of the element is initiated in a clockwise or counterclockwise direction, as previously explained, the spring 97 is initially increasingly compressed as the element rotates from one display position to another until the force vector 99 shown in phantom moves past the pivot point/shaft 9, as the element 1 rotates (in the illustration shown as the element rotates clockwise, the force vector 99 moves to the right), after which time the compressive force stored in spring 97 begins to release, assisting in completing the rotation of the display element 1, (for displaying lower face 7, in the illustration given). After such rotation, the display element 1 will be in the position show in FIG. 4B.

In a preferred embodiment of the invention, the spring 97 is replaced by a weight 101 attached to the display element 1 at substantially the point of attachment shown for the spring 97. The weight 101, in this example, provides a constant downward force vector 99 (the force vector 99 is variable when spring 97 is employed instead of weight 99), for assisting in completing the rotation of the display element 1. For example, with the display element in the position shown in FIG. 4A, as the element is rotated to change the display from face 5 to face 7, the force vector 99 will move past the pivot point 9, at which time the downward force 99 of weight 101 will assist in completing the substantially 90° clockwise rotation of the display element 1, for example. Conversely, when a display element is in the position shown in FIG. 4B, for displaying face 7, upon initiation of counterclockwise rotation of display element 1 to change to the display of face 5, the force vector 99 moves to the left, and when past the pivot shaft 9, assists in completing the counterclockwise rotation of element 1 in its opposite direction.

Figure 5B:
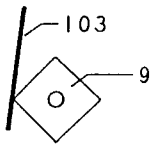
FIGS. 5A and 5B show a pictorial diagram of a detail of a square shaft and flat spring coacting embodiment of the invention for maintaining a display element in a stable position, and for assisting in completing the rotation of a display element from one stable position to another, respectively.
Figure 5A:
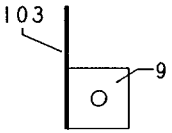

In an alternative embodiment of the invention, instead of using either a spring 97 or a weight 101, the shaft 9 can be made square or eccentric, as shown in FIG. 5A. A flat spring 103 is rigidly attached at an appropriate position on an associated support wall 10 juxtaposed to the display element 1. The spring 103 is positioned to interact with the shaft 9 as shown in FIG. 5A. As the display element 1 is rotated in a clockwise or counterclockwise direction, the spring 103 will be flexed or displaced for an initial portion of the rotation of element 1, (See FIG. 5B). After about 45° of rotation, the spring 103 will exert a force upon shaft 9 for completing rotation of the element 1, and will also provide an additional benefit of detenting the element 1 into position. However, due to the cost of manufacture and additional complexity, the present inventor believes that the preferred embodiment is to use the weight 101 as previously described, in which application the weight centroid is located for providing the desired stable position states of the display element or display elements 1. Also, instead of using a separate weight 101 rigidly attached at an appropriate position on each display element 1, each of the elements 1 can be designed with internal weight distributed to provide the desired stable states, in addition to the rotational assistance after about 45° of rotation of an element 1.

As indicated above, as an actuator assembly 15 is scanned or moved across the rear of the display elements 1, extended ones of the actuators 17 and 18 will contact the ramps 11,13, respectively, of display elements 1 requiring changing. If an element 1 is already in a desired position, the extended actuator will not make contact with a ramp of that element 1, leaving the element in its original and desired position. The initial contact of an actuator 17 or 18 with a ramp 11 or 13, respectively, of a display element 1, must overcome the force vector produced by the weight 101 that is countering rotation of the associated element 1 in the desired clockwise or counterclockwise direction for changing the display provided by that element 1. As the actuator assembly 15 overcomes the opposing torque and rotates the element to a position where the force vector is shifted over to pivot point 9, the force vector will generate a torque in the reverse direction for aiding rotation of the display element in the desired direction. The element 1 continues to rotate until it is stopped by an appropriate detent mechanism, to be described below.

Figure 2C:
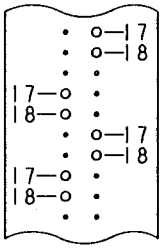
FIG. 2C shows an arrangement of actuators in a front view of an actuator assembly of the invention.
Figure 7:
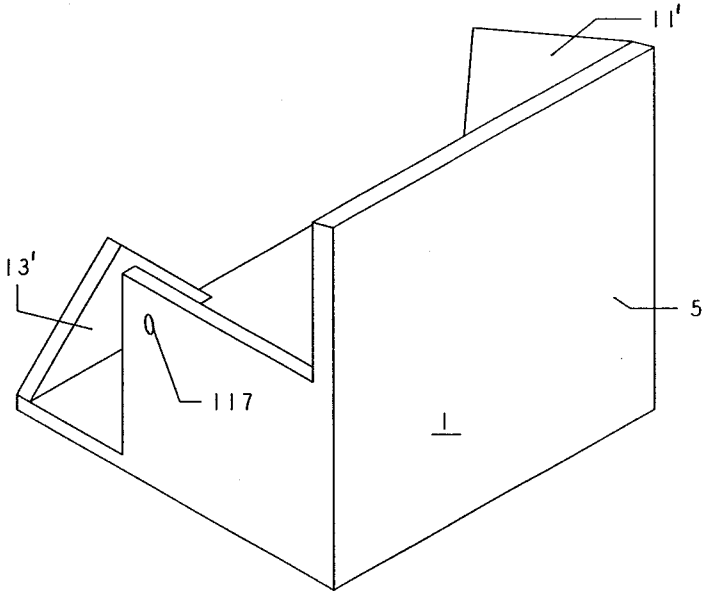
FIG. 7 shows a perspective view of a display element of yet another embodiment of the invention.
Figure 6:
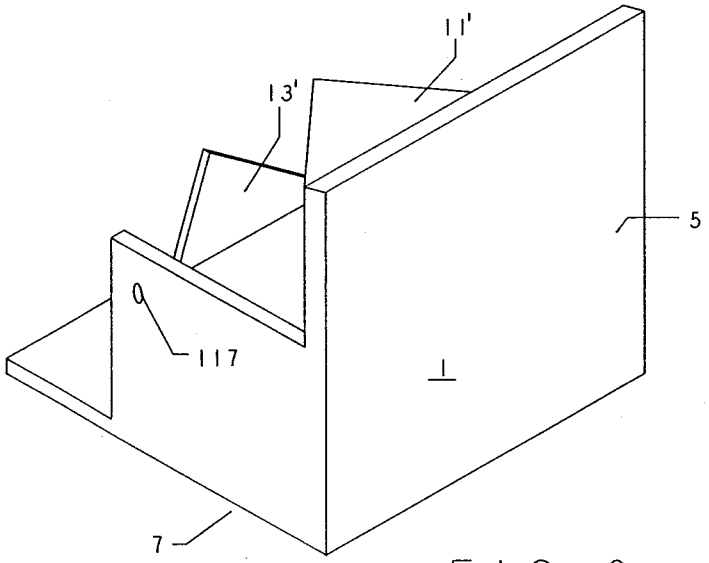
FIG. 6 shows a perspective view of a display element of another embodiment of the invention.

Because of the juxtaposition between odd and even rows of the display elements 1, the elements 1 must be rotated in a manner to avoid interference between the juxtaposed rows. In one embodiment of the invention, the pairs of actuators 17,18 are offset from one another on the carriage 15 as shown on FIG. 2C. In an alternative embodiment of the invention, the actuators 17 and 18 can be arranged in a single column without staggering, provided that the upper and lower face ramps 11 and 13, respectively, are offset from one another. One such arrangement is as shown in FIG. 6, where the upper face ramp 11′ is offset to the left relative to face 5, and the lower face ramp 13′ is offset to the right relative to face 7. Alternatively, as shown in FIG. 7, the upper face ramp 11′ is offset to the right relative to face 5, and the lower face ramp 13′ is offset to the left relative to the lower face 7. However, the offset ramps 11′ and 13′ of FIGS. 6 and 7 are much steeper than the ramps 11 and 13 shown in FIG. 1 for each display element 1. Accordingly, the offset ramps 11′ and 13′ tend to require the application of a much greater instantaneous force upon these ramps, relative to that required upon ramps 11 and 13, in order to apply sufficient torque to rotate the display elements 1 from one display position to another. As a result, the rotary motor 23 will be required to provide a much greater instantaneous torque in the repositioning of the display elements 1.

Figure 8A:
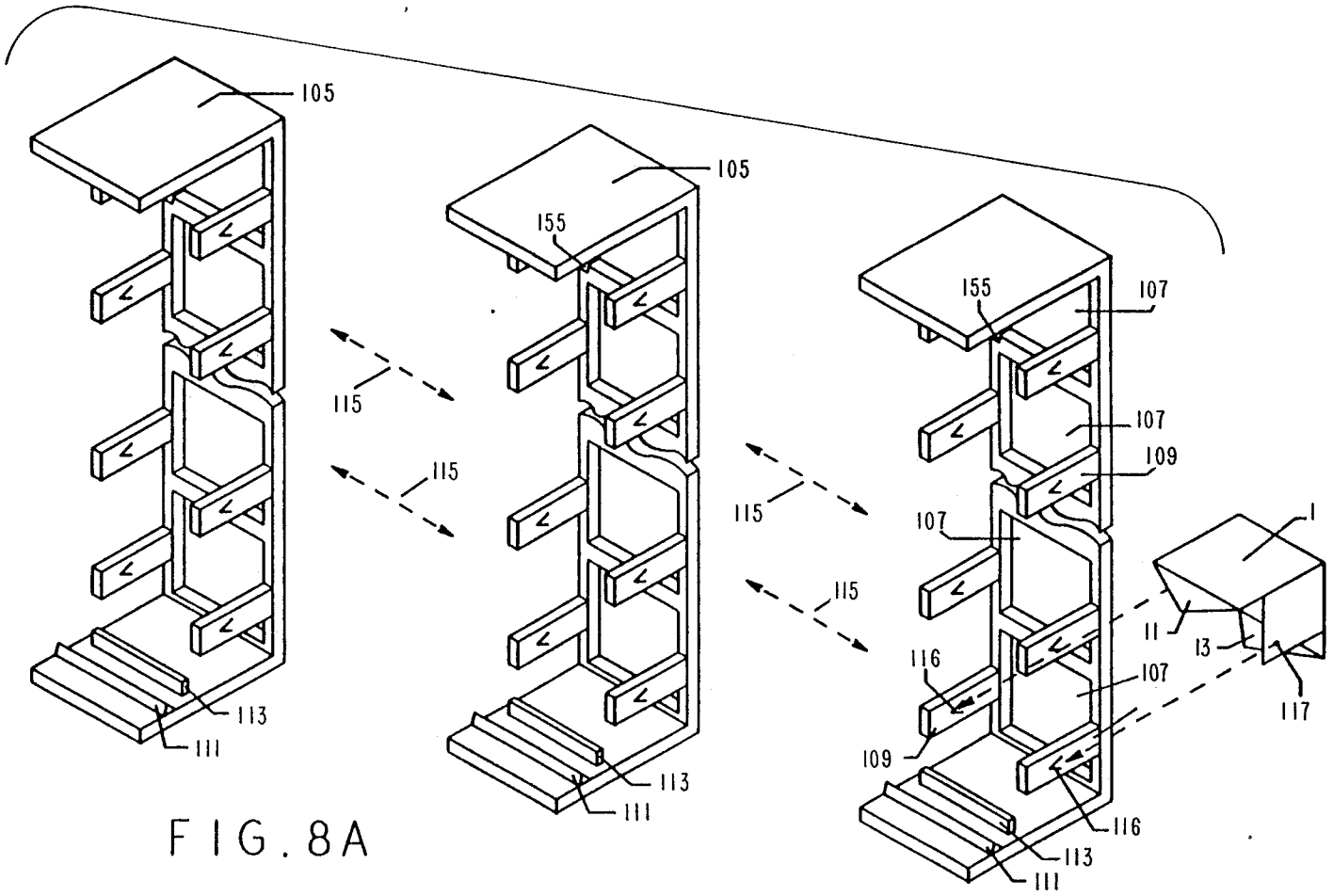
FIG. 8A is a pictorial view of an exploded assembly of a modularized frame embodiment of the invention.

In another embodiment of the invention, as shown in FIG. 8A, the frame 3 is provided by a plurality of individual modules 105. The frame modules 105 can be fabricated from any suitable material, such as plastic material, for example. Also, the modules 105 are readily adaptable to injection molding when made from an appropriate plastic material. The modules 105 can be glued together, solvent cemented, or ultrasonically welded together, to provide the frame 3. Also, as an alternative, a rail (not shown) can be utilized for securing the tops and the bottoms of the modules 105 along retaining grooves in the rail, permitting the modules 105 to be pushed together via compression, and locked in place by appropriate means.

As shown, the modules 105 include one column of openings 107 for display elements 1; display element support arms or walls 109 located on either side of each of the openings 107; a segment of a track 111 upon which the carriage or actuator assembly 15 moves; and a timing flag 113. The display elements 1 are mounted via the pivot shaft 9 between the element support arms 109. Holes 116 are provided for receiving the pivot shaft 9. Similarly, holes 117 in the display elements 1 are provided for receiving the pivot shaft 9. As further shown in FIG. 8A, the individual frame modules 105 are assembled together in juxtaposition as indicated by the phantom arrows 115.

Figure 8B:
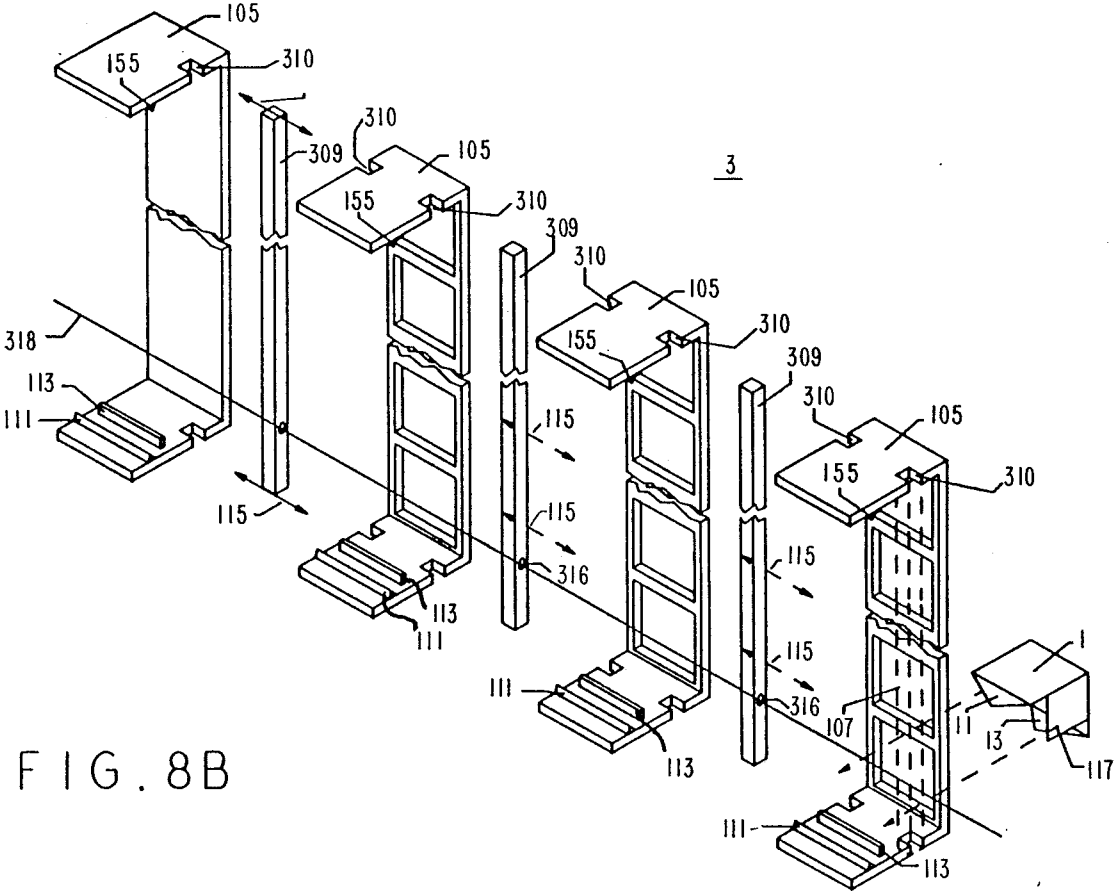
FIG. 8B is a pictorial view of an exploded assembly of an alternative modularized frame embodiment of the invention.
Figure 8C:
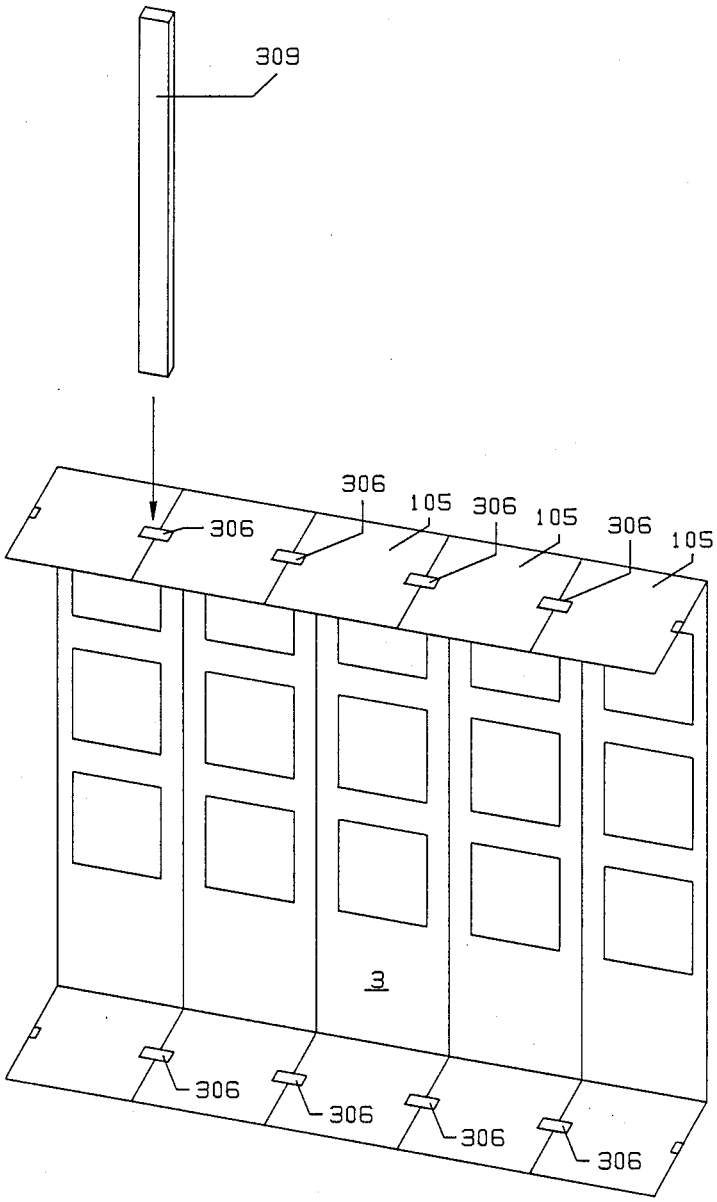
FIG. 8C is a pictorial view of the modularized frame embodiment of FIG. 8B for showing an alternative method of assembly for one embodiment of the invention.

In FIG. 8B, a pictorial view is shown of an alternative modularized frame embodiment for providing the frame 3. As shown, the alternative embodiment is substantially the same as the modularized frame embodiment of FIG. 8A, with the difference being that the element support arms 109 of FIG. 8A are replaced by vertical post 309, with holes 316 for receiving the pivot shafts 9. Also, each module 105 further includes open notches 310 for locating the post 309 in the assembled frame 3. The post 309 can be rigidly fixed within the notches 310 via the use of an appropriate epoxy, glue, ultrasonic welding, and so forth. Note that in FIG. 8B, the individual frame modules 105 and associated post 309 are assembled together in a horizontal fashion for making up the frame 3. An alternative method of assembly is shown in FIG. 8C, where the frame 3 is either assembled in one piece or from the individual modules 105, without the post 309. After assembly of the basic frame 3, slots 306 are formed by the mating of individual notches 310, for receiving post 309 via vertical insertion of the post 309 through the slots 306, as shown. Note a piano wire 318 strung through holes 316, in posts 309, as shown, can be used to provide the pivot shafts 9.

Figure 10:
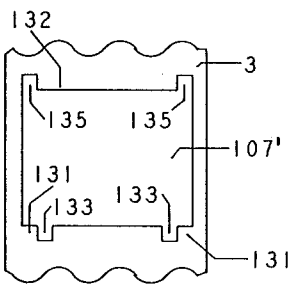
FIG. 10 shows the opening or cutout configuration in the frame of the front panel of the display for accommodating rotation of the display element embodiment of FIGS. 9A and 9B.
Figure 9B:
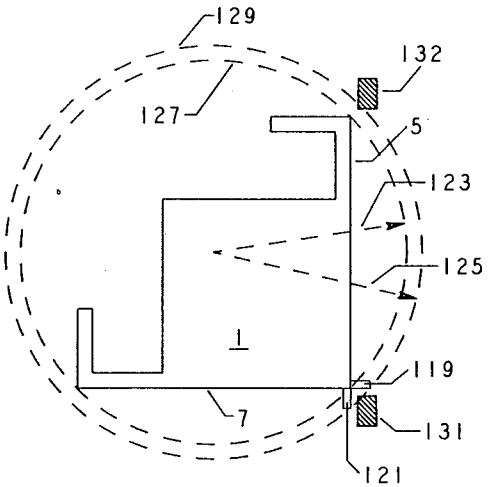
FIG. 9B is a pictorial diagram showing the interaction between the stop studs and frame in rotating an element between its two display positions.
Figure 9A:
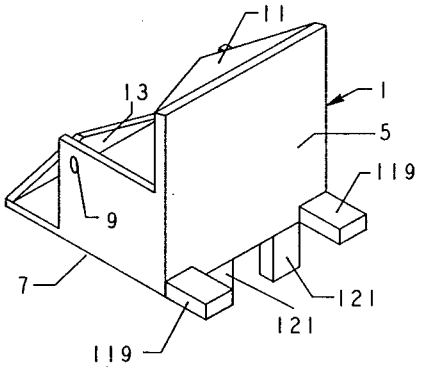
FIG. 9A shows an alternative embodiment of the invention for a display element including stop studs or projections.

In FIG. 9A, a display element 1 of another embodiment of the invention includes stop studs or stop projections 119 located along the bottom edge of the upper face 5 inwardly from the bottom corners of face 5, and projecting outward from face 5. Another pair of stop stud or stop projections 121 are located at the upper corners of the bottom face 7, projecting outward from face 7, as shown. As shown in FIG. 9B, the corners of the display element 1 rotate about a minor radius designated by arrow 123. The outwardmost ends of the stop studs 119 and 121, relative to display element 1, rotate about a major radius shown as arrow 125. The concentric phantom circles 127 and 129 show the paths of travel circumscribed by the rotation of the minor and major radii 123,125, respectively. In the position of display element 1 shown in FIG. 9B, the stop studs 121 are resting against the inside surface of the frame opening associated lower cross member 131. With further reference to FIG. 10, the opening 107 must be modified to have the configuration of opening 107'. The notches 133 permit the stop studs 121 to pass through unobstructed by the frame 3 when the display element 1 is rotated in a counter clockwise direction to change the display from an upper face 5 to a lower face 7. After rotating in a counterclockwise direction for 90°, the stop studs 121 will rest against the inside surface 132 associated with the frame opening 107', retaining the display element 1 in proper orientation for displaying the lower face 7. The stop studs 119 will have passed through notches 135. When the display element 1 is next rotated 90° clockwise, for changing the display to the front face 5, the stop studs 119 will pass unobstructed through the notched openings 135. Also, the stop studs 121 will pass unobstructed through the notches 133, as element 1 returns to the position shown in FIG. 9B.

Figure 11B:
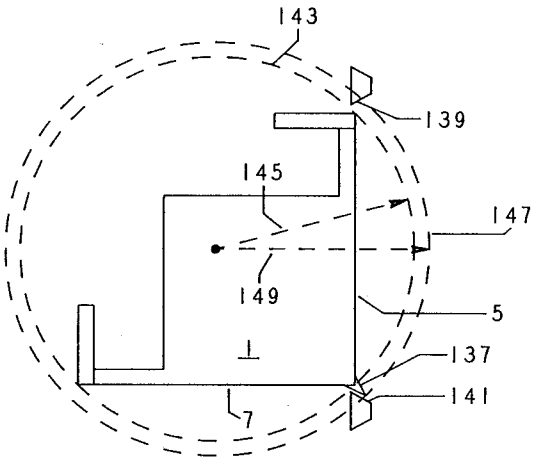
FIG. 11B shows the coaction between a triangular stop surface of a display element and the frame in rotating the display element between its two extreme positions or two stable states.
Figure 11A:
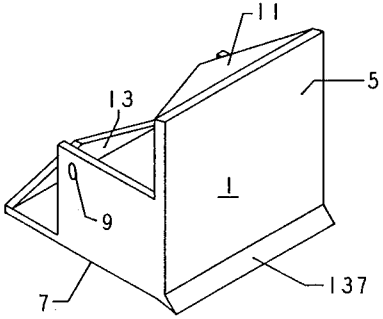
FIG. 11A shows another embodiment of the invention for a display element including a triangular stop surface.

As an alternative embodiment to use of the stop studs or projection pairs 119 and 121 as shown in FIG. 9A, a two-sided triangular stop surface 137 can be provided between the lower edge of upper face 5 and the upper edge of lower face 7, as shown in FIG. 11A. As shown in FIG. 11B, the triangular stop surface 137 has a triangular cross section. In this embodiment, notched cutouts 133,135 are not required for the opening of the frame as in the last discussed embodiment. In this embodiment, as shown in 11B, the upper and lower edges 139 and 141, respectively, of the frame opening 107 are angled for mating with the triangular stop surface 137 of the display element 1. During rotation of the display element 1, the corners circumscribe a circle 143 having a radius 145, whereas the triangular stop surface 137 circumscribes a circle 147 having a radius 149. In this embodiment, a display element need only rotate 90° clockwise for changing the display from displaying the lower face 7 to an upper face 5, as shown. The triangular stop surface 137 rests against the inside edge of the frame 141, retaining display element 1 in appropriate alignment. To change the display, display element 1 is rotated 90° counterclockwise for displaying the lower face 7, in which position the triangular stop surface will rest against the upper inside edge 139 of the frame 105.

Figure 12:
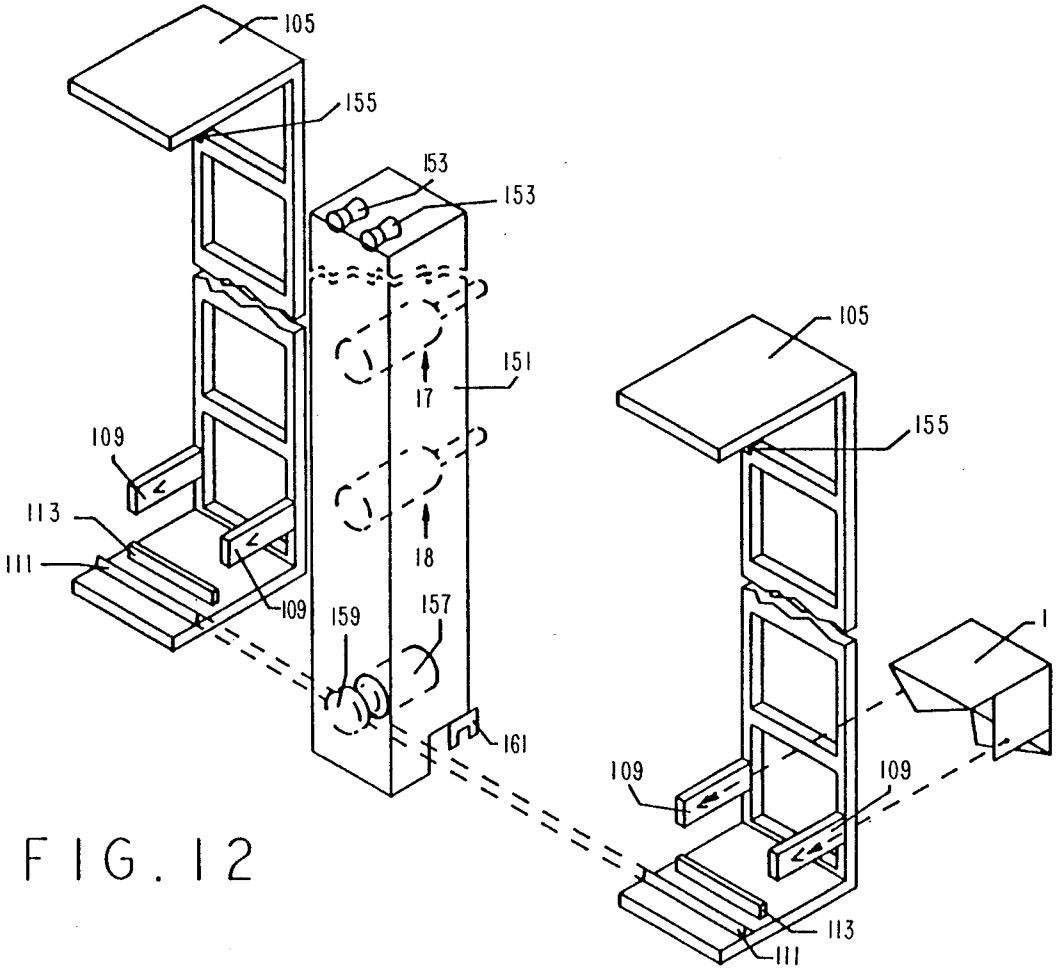
FIG. 12 is a pictorial view of an exploded partial assembly of another embodiment of the modularized embodiment of the invention.

In FIG. 12, an embodiment is shown for providing a carriage assembly 151 mounted upon the track 111 formed by the assemblage of the juxtaposed modules 105, the carriage 151 further including a pair of guide wheels 153 for contacting the upper track 155 on he inside surface of the tops of the modules 105. Accordingly, the carriage 151 is both held in proper alignment and retained by the lower and upper tracks 111 and 155. In this example, the motor 157 drives a drive wheel 159 for moving the carriage 151 back and forth along track 111. Note that a pair of actuators 17 and 18 are shown in phantom on the carriage 151. A positional sensor 161 is shown mounted at a lower portion of the carriage 151 for travelling along the flags 113 to provide positional signals indicative of the position of the carriage 151 at any given time.

Figure 13:
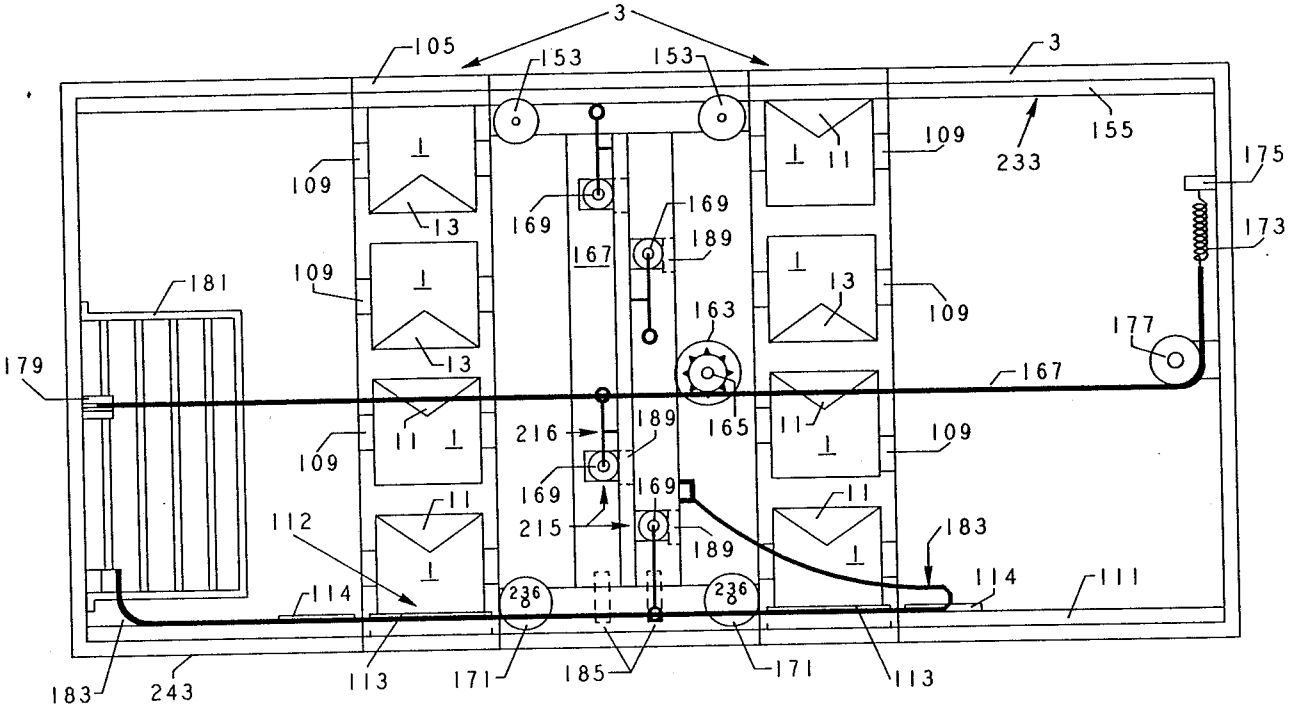
FIG. 13 is a pictorial diagram from the rear of a portion of a display apparatus incorporating various embodiments of the invention, including an alternative embodiment for the drive mechanism for moving carriage for the actuator assembly embodiment.

In FIG. 13, the back or rear portion of a display apparatus incorporating various embodiments of the invention is shown. A positive drive configuration is shown including a drive motor 163 for driving or turning a sprocket or gear wheel 165 that interacts with a drive belt 167 having holes (not shown) into which the sprockets of the sprocket wheel protrude in moving the carriage 167. Note that the mechanism or drive system for driving carriage 167 can also be providing by mechanisms including lead screws, a rack and pinion gearing, or linear motor, and so forth.

Escapement assemblies 169 are offset from one another to provide appropriate timing for movement of display elements between adjacent rows that avoids interference between the elements 1 as they rotate, as previously explained. A pair of lower guide wheels 171 secure the carriage 167 to, and allow it to move along, the track 111. The drive belt 167 is secured at one end via a spring 173 to a bracket 175, and partially wrapped around an idler wheel 177 near this end. The other end of the drive belt 167 is rigidly held by clamp 179 at the left end of the frame 3. The spring 173 and idler wheel 177 maintain the drive belt 167 under proper tension and in proper alignment, respectively. A printed circuit board cage 181 is located at the left end of the frame 3 for retaining the electronic controller (not shown) and associated power supply (not shown) for the display apparatus, in this example. A flexible electrical cable 183 is connected between the printed circuit board cage 181 and the carriage assembly 167 for both providing electrical drive signals to the motor 163, and actuation signals or voltages to the escapement assemblies 169. The flexible cable 183 also carries carriage position signals, and signals indicative of the position of each one of the display elements 1. Positional sensor or sensors 185 are mounted at the bottom of the carriage 167 for sensing the timing flags 113 in order to provide positional signals for the carriage 167 to the electronic controller.

Figure 14:
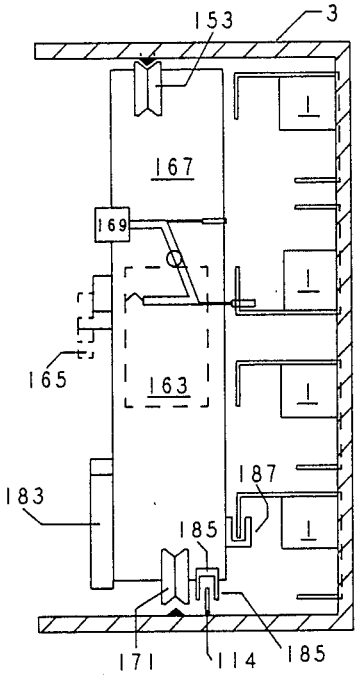
FIG. 14 is a sectional view taken along 14—14 of the pictorial diagram of FIG. 13.

In FIG. 14, a cross-sectional view taken along 14—14 of the display assembly of FIG. 13 is shown. Note that one of a plurality of sensors 187 is shown mounted upon the carriage 167 for sensing positioning of the display elements 1 in the lowermost row of elements 1.

Spaces between the flags 113 and 114 are sensed by sensors 185 for providing signals indicative of times that the solenoids 39 associated with the escapements 169 can be changed from one state to another, such as from an energized to non-energized state or vice-versa. The element position sensors 29 and 31 are staggered, in this example, and each are in line with either the odd row or even row ones of the solenoids 39 of the staggered escapement assemblies 169. Signals provided by the sensors 29 and 31 permit signal processing for rotating display elements 1 in either odd or even rows in a simultaneous manner, but avoids the rotation of juxtaposed display elements 1 in odd and even rows thereof, as previously mentioned. Half-timing flags 114 are included at either end of the matrix of display elements 1, for providing signaling via sensors 185 indicative of times that the carriage 167 clears either one of the half-flags 114. In this manner, the carriage 167 can be prevented from jamming into either end of the frame 3.

A plurality of sensors 29 and 31 are included for determining the position of the display elements 1, providing electrical signals indicative of such positioning. As previously, explained if only one sensor 187 is included per row of display elements 1, position sensing can only be provided unidirectionally relative to movement of carriage 167. If two sensors 29 and 31 are used, on either side of an upper face actuator 17 or lower face actuator 18, respectively, bidirectional sensing of each row of display elements is provided. Lastly, if four sensors 187 are included with one (sensors 29) on either side of the upper face actuators 17, and one (sensors 31) on either side of the lower actuators 18, failsafe sensing is provided, in view of each one of the display elements having but two stable states. As previously explained, this will permit signaling to sense jamming of the elements 1 or some other fault condition such as a faulty sensor.

Note also that the flexible cable 183 folds upon itself as the carriage 167 moves back and forth from one end of the frame 3 to the other in scanning the display elements 1. Alternatively, a spring-loaded tensioner can be used, but this would be more costly for preventing tangling.

Figure 15:
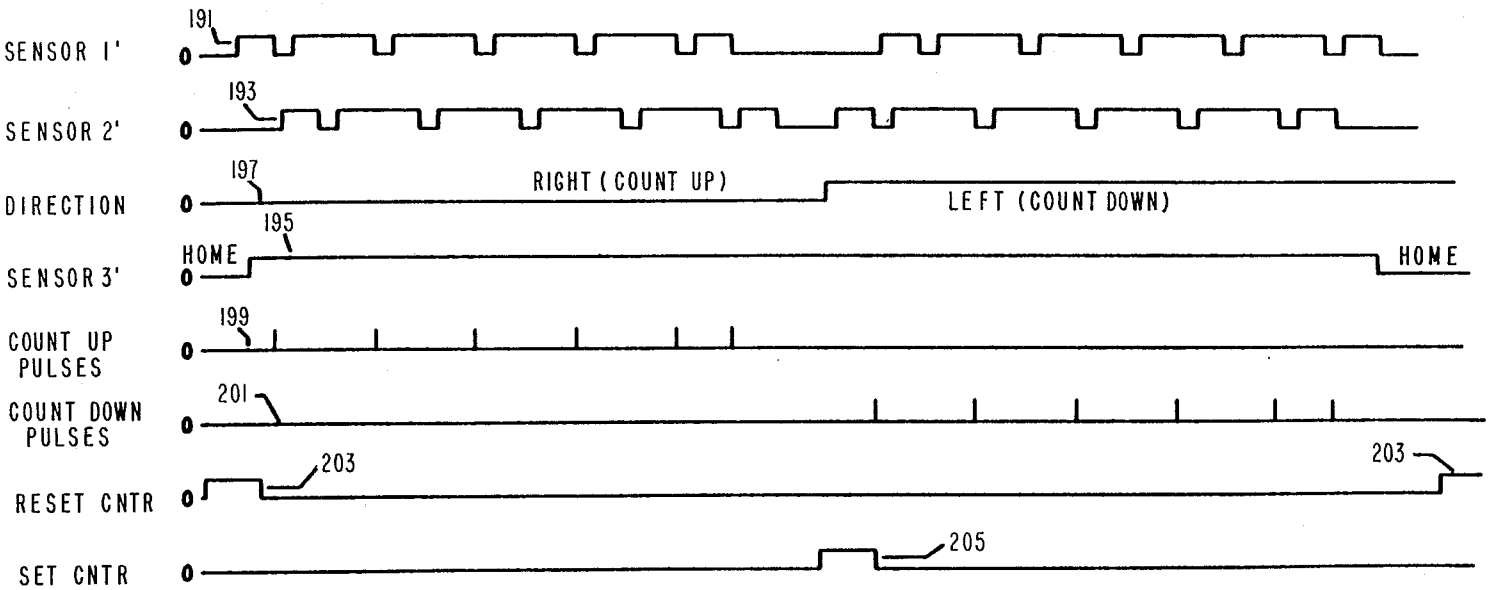
FIG. 15 shows a typical timing diagram for the electronic controller in one embodiment of the invention.

A brief discussion of the functioning of the electronic control system (not shown) will now be made with reference to the timing diagram of FIG. 15. When power is initially applied to the display apparatus the electronic controller is programmed to cause the carriage 167 to move to the left or "home" position. The two carriage position sensors 185 are displaced from one another by slightly less than half the width of a display element 1. Also, as previously mentioned, the sensors 185 are aligned with their associated column of solenoids 39 and actuators 17,18, respectively. In other words, one of the sensors 185 is associated with even rows of the display elements 1, whereas the other of the pair of sensors 185 is associated with odd rows of the display elements 1. In this manner, the display elements can be mounted more closely together while avoiding interference problems during rotation of the elements 1. As the carriage 167 is moved across each column of display elements 1, odd and even rows of the associated display elements 1 will be rotated in an alternating manner, as previously explained.

The timing diagram shown is for display apparatus including four columns of display elements 1. Timing for both right movement and left movement scans of the carriage 167 are shown. Timing for a right scan is shown in the first half of the diagram, moving from left to right. The timing signals labeled 191 are associated with one of the sensors 185, noted for purposes of explanation as "Sensor 1'" in FIG. 15. The timing signals 193 are associated with the other sensor 185 designated as "Sensor 2'". The phase displacement shown between the timing signals 191 and 193 is indicative of the physical offset or displacement between the pair of sensors 185. Whenever the output signal from one of the sensors 185 is low or at zero volt, in this example, solenoids 39 in line with that sensor may be either energized or de-energized, as required. Alternatively, whenever one of the sensors 185 is outputting a "high" or positive voltage signal, in this example, the solenoids 39 in line with that sensor 185 must remain in whatever energization or de-energization state they happen to be in.

The timing signals 193 are associated with a sensor designated for purposes of illustration as "Sensor 3'". A sensor corresponding to Sensor 3' is not shown in the present figures. However, such an additional sensor would be located for identifying home positions relative to the right end extreme position for the carriage 167. If such a Sensor 3' is utilized, whenever the sensors 185 corresponding to sensors 1' and 2' are each providing a low signal, the carriage 167 is in its "home" position, which relative to viewing the display apparatus from the rear is at the extreme leftward positioning of the carriage 167. At that position, the sensors 1' through 3' provide a low or zero volt signal, in this example, indicative of the "home" positioning of the carriage 167. The carriage 167 can only move toward the right from its home position. As shown on the timing diagram, when the carriage 167 moves from its home position to its extreme rightward position, sensors 1' and 2' will provide a low-level signal, along with sensor 3' continuing to provide a high-level signal, indicating that the carriage 167 has obtained its extreme rightward movement, and must now reverse direction and move leftward back toward its home position. Such signaling is shown near the center of the timing diagram.

Each column of display elements 1 is associated with a designated memory address of a memory (not shown) included in the electronic controller (not shown). When the carriage 167 is in its "home" position, a memory address counter (not shown) is reset. Also, a motor direction timing signal 197 is low at this time, for causing the memory address counter to count up. In this example, the address receives a count-up pulse in response to termination of the timing pulses 191. Each time a count-up pulse is received by the address counter, it operates to increment the column address. The column address is then processed for selectively actuating or deactivating the appropriate solenoid 39 of an escapement assembly 169.

When the carriage 167 moves to its extreme rightmost position, the controller senses the simultaneous occurrence of low-level signals from sensors 1 and 2, and the high-level signal from sensor 3, for causing the direction signal 197 to go high. The high-level direction signal 197 causes the counter to now count down and the motor 163 to reverse direction for now moving carriage 167 to the left. Countdown pulses 201 are generated with each termination of the timing pulses from sensor 2', for decrementing the address counter with each occurrence of a countdown pulse, until the carriage 167 moves back to its "home" position.

By designing the electronic controller to provide count-up pulses 199 with each falling edge or termination of the timing pulses 191, and countdown pulses 201 to be produced with each falling edge or termination of the timing pulses 193, the address counter is maintained in a proper state for insuring appropriate control of the solenoids 39 regardless of he direction of movement of the carriage 167. However, as previously mentioned, the solenoids 39 may not change operational state unless the active one of the timing pulses 191 or 193 are producing a low-level signal, as previously explained.

Through use of the above-described electronic controller functions and methodology, the carriage 167 can move in either direction with the escapement assemblies 169 changing state only when new information is provided to memory locations associated with the various display elements 1. Also, in this manner, "logic seeking" may be utilized, for changing selected ones of the columns without affecting others. Also, the control approach permits the use of sensors 185 for scanning the position of the display elements 1 without actually changing the position of the display elements. The generally described control system is asyncronous with timing signals being generated through the use of the timing flags 113, as described. With reference to the timing diagram of FIG. 15, note that the electronic controller provides a reset pulse 203 whenever the carriage 167 is in its home position, and a set control signal or pulse 205 when the carriage 167 attain its rightmost position. The reset pulse 203 and set pulse 205 are used to insure that system counters (not shown) are always in a proper state.

It is expected that the display elements can be sized for providing characters as small as 1½ inches. The display elements 1 are weighted in a manner providing for rotation of less than 45° in order to have the element complete a 90° rotation without any further force being imparted to it.

Although various embodiments of the invention have been shown and described herein for purposes of illustration of the invention, other embodiments may occur to those of skill in the art which are covered by spirit and scope of the appended claims.

What I claim is:

1. A display apparatus comprising:

a plurality of rotationally mounted display elements arranged into a matrix of rows and columns, the axes of rotation of said display elements being perpendicular to each associated column and parallel to each associated row, respectively, said display elements each including first and second display faces perpendicular to one another and joined along respective adjacent edges, for providing a desired arrangement of said display faces at the front of said display apparatus;

first and second ramp surfaces rigidly connected along inside edges of and extending substantially perpendicularly away from a back surface of said first and second faces, respectively, opposite the edges joining said first and second display faces, respectively; and actuator means adapted for bidirectional movement along a path parallel to the axes of rotation of said display elements at the rear of said display apparatus, for stroking selected ones of said first and second ramp surfaces with sufficient force to cause the associated display elements to rotate 90 degrees for changing the pattern of associated first and second faces to form a desired display.

2. The display apparatus of claim 1, wherein said first and second ramp surfaces each form a triangle with their associated edge.

3. The display apparatus of claim 2, wherein said first and second ramp surfaces are offset from one another to prevent interference between rotating ones of said display elements in juxtaposed rows.

4. The display apparatus of claim 1, wherein said actuator means includes:

a carriage at least as long as one column of said display elements;

drive means for moving said carriage bidirectionally behind said columns of display elements; and a plurality of pairs of first and second actuator arms mounted upon said carriage, an individual one of said first and second actuator arms of each pair of actuator arms being selectively actuatable, at a given time, for extending one end of the selected arm into a path of travel for stroking selected ones of said first and second ramps, respectively, for rotating said display elements 90 degrees for changing the face of said display elements being displayed from either (1) a second face to a first face, or (2) a first face to a second face, respectively.

5. The display apparatus of claim 4, wherein said actuator means further includes a plurality of rollers attached to the ends of each one of said first and second actuator arms, said rollers providing the contacting surface for stroking said first and second ramps.

6. The display apparatus of claim 4, wherein said actuator means further includes a plurality of motive means connected to each pair of said first and second actuator arms, respectively, for selectively moving said first and second actuator arms into or out of a path of travel for intersecting selected ones of said first and second ramps, respectively.

7. The display apparatus of claim 6, wherein said plurality of motive means each include at least one solenoid, and means for connecting said solenoid to said first and second actuator arms.

8. The display apparatus of claim 7, wherein said connecting means includes:

a plunger of said solenoid connected to the other end of the associated said first actuator arm;

an escapement rod pivotally connected between the other end of said first actuator arm, and a median portion of said second actuator arm, for causing said first and second actuator arms to move in opposite directions; and a spring connected between the other end of said second actuator arm and a frame of said carriage means, said spring being expanded upon energization of said solenoid causing said first actuator arm to move toward said carriage out of the path of said first ramps, and second actuator arm to move away from carriage into the path of said second ramps, whereupon deenergization of said solenoid, said spring contracts to move said second actuator arm toward said carriage means out of the path of said second ramps, and said first actuator arm to move away from said carriage means into the path of said first ramps.

9. The display apparatus of claim 4, wherein successive pairs of said first and second actuator arms are staggered from one another, and form two columns, one column being associated with even numbered rows of said display elements, and the other column being associated with odd numbered rows of said display elements.

10. The display apparatus of claim 1, wherein portions of said first and second faces of said display elements are covered with either one or a combination of reflective and non-reflective materials for providing a front lit display including means for lighting the front of the display.

11. The display apparatus of claim 1, wherein portions of said first and second faces of said display elements consist of either one or a combination of opaque, translucent, and transparent materials for providing a back lit display including means for lighting the back of said display elements.

12. The display apparatus of claim 1, wherein portions of said first and second faces of said display elements consist of either one or a combination of reflective, non-reflective, opaque, translucent, and transparent materials.

13. The display apparatus of claim 1, further including a plurality of spring biasing means connected between each one of said display elements, respectively, and a frame of said display apparatus, for assisting in the completion of a 90 degree rotation of each associated one of said display elements.

14. The display apparatus of claim 1, wherein each one of said plurality of display elements include a weigh positioned away from the axis of rotation of its associated display element, and rigidly attached thereto for providing a force vector for assisting in the completion of a 90 degree rotation of each associated one of said display elements.

15. The display apparatus of claim 1, further including:

frame means for providing a matrix of rows and columns of openings in one plane of orientation for forming a display surface for said display apparatus at the front of said frame means; and a plurality of pairs of parallel support wall means rigidly mounted on a back surface of said frame means behind said openings, for providing surfaces for rotationally mounting said plurality of display elements behind said openings, for displaying either of said first and second faces of each element through an associated opening of said frame means at a given time.

16. The display apparatus of claim 15, further including carriage means mounted upon said frame means behind said plurality of display elements, for moving bidirectional along a path of travel both juxtaposed and substantially parallel to the ones of said first and second ramps associated with nondisplayed ones of said first and second faces, said actuator means being mounted upon said carriage means.

17. The display apparatus of claim 16, wherein said frame means includes:

a top and a bottom; and upper and lower track formed along inside surfaces of said top and bottom portions of said frame means, respectively, said upper and lower tracks being parallel to and spaced away from the back of the display face of said frame means;

said carriage means being mounted between said upper and lower tracks, and including means for moving along said tracks.

18. The display apparatus of claim 17, wherein said frame means further includes a plurality of timing flag means mounted along its bottom portion in parallel with said lower track, for providing detectable timing flags indicative of the position of said carriage means at any given time.

19. The display apparatus of claim 18, wherein said frame means further includes a plurality of individual modules, each module providing an identical section of said frame means, each module further providing at least one column of said openings, and including a portion of said plurality of pairs of parallel support wall means rigidly mounted behind said openings, a section of said upper track along the inside surface of the top of said module, a section of said lower track along the inside surface of the bottom of said module, and a section of said plurality of timing flag means, said modules being rigidly joined together to form said frame means.

20. The display apparatus of claim 18, wherein said frame means further includes:

a plurality of individual modules, each module providing an identical section of said frame means, each module further providing at least one column of said openings, a segment of the top and bottom portions of said frame means, a segment of said upper and lower tracks on the inside surfaces of said top and bottom portions, a segment of said timing flag means on the inside surface of said bottom portion, a first pair of notches located parallel to one another on opposite edges of the top portion, and a second pair of notches located parallel to one another on opposite edges of the bottom portion; and a plurality of vertical posts for mounting between opposite ones of one of said first and second pairs of notches, for providing said plurality of pairs of parallel support wall means;

said plurality of modules and vertical posts being rigidly mounted together for forming said frame means.

21. The display apparatus of claim 15, wherein each one of said plurality of display elements includes a plurality of stop studs projecting from said first and second faces adjacent a common edge therebetween, for striking the top and bottom edges of the associated opening in said frame, respectively, for preventing said display elements from rotating more than 90 degrees in either direction.

22. The display apparatus of claim 15, wherein each one of said plurality of display elements includes stop surface means projecting outward from the common edge between the first and second faces thereof, for striking top and bottom edges of the associated opening in said frame, respectively, for preventing said display elements from rotating more than 90 degrees in either direction.

23. The display apparatus of claim 16, further including:

timing flag means mounted along the inside of a bottom surface of said frame means, for providing detectable periodic timing flags along the width of said frame means; and detection means mounted upon carriage means for detecting said timing flags to produce electrical timing signals indicative of the position of said carriage means at any given time.

24. The display apparatus of claim 16, further including sensing means mounted upon said carriage means for detecting at least one of said first and second ramps of said display elements, for producing electrical signals indicative of the position of said display elements upon movement of said carriage means.

25. A display apparatus comprising:

frame means for providing a matrix of rows and columns of openings in one plane of orientation, said frame means having a front surface forming a display surface for said display apparatus, and a rear or back surface;

pairs of parallel support members rigidly mounted to said frame means behind said openings on the back surface of said frame means, said support members being parallel to one another in each associated row, and substantially identically oriented in each row relative to every other row of said matrix;

a plurality of display elements rotationally mounted between each pair of support members, respectively, each element having first and second individually addressable display faces perpendicular to and joined to one another along a respective edge, for displaying either of said first and second faces through an associated opening of said frame means at a given time, and first and second ramp surfaces rigidly connected to the inside edges of said first and second faces, respectively, opposite said edges where said first and second faces are joined together, said first and second ramp surfaces extending substantially perpendicularly away from said first and second display faces, respectively;

carriage means adapted for moving behind said display elements, at the area of said frame means, in a plane of travel both (1) juxtaposed and substantially parallel to the ones of said first and second ramps associated with nondisplayed ones of said first and second face, respectively, and (2)substantially parallel to the axes of rotation of said display elements; and actuator means mounted on said carriage means for selectively engaging particular ones of said first and second ramp means, for causing 90 degree rotation of the associated display elements in planes of rotation substantially perpendicular to the plane of movement of said carriage means, for changing the ones of said first and second faces being displayed to obtain a desired pattern of these faces for display.

26. A display element for a display apparatus, comprising:

first and second display faces perpendicular to one another and joined along respective adjacent edges;

left and right side walls relative to said first and second display faces, said left and right side wall providing mounting surfaces for rotationally mounting said display element; and first and second ramps located along inside edges of and extending substantially perpendicularly away from an inside surface of said first and second faces, respectively, said first and second ramps being receptive of a mechanical contacting force generated by an actuator sweeping thereacross for rotating said display element 90 degrees.

27. The display element of claim 26, wherein each one of said first and second ramps are triangularly shaped.

28. The display element of claim 26, wherein said first and second ramp surfaces are offset from one another to prevent interference between rotating ones of juxtaposed rows of a plurality of said display elements in said display apparatus.

29. The display element of claim 26, wherein portions of said first and second faces are covered with either one or a combination of reflective and non-reflective materials.

30. The display element of claim 26, wherein portions of said first and second faces consist of either one or a combination of opaque, translucent, and transparent materials.

31. The display element of claim 26, wherein portions of said first and second faces consist of either one or a combination of reflective, non-reflective, opaque, translucent, and transparent materials.

32. The display element of claim 26, further including a weight positioned away from the axis of rotation of said display element, and rigidly attached thereto for providing a force vector for assisting in the completion of a 90 degree rotation of said display element.

33. The display element of claim 26, further including a plurality of stop studs projecting from said first and second faces adjacent a common edge therebetween, for striking the top and bottom edges of an associated opening in said frame of said display apparatus, respectively, for preventing said display element from rotating more than 90 degrees in either direction.

34. The display apparatus of claim 26, further including stop surface means projecting outward from the common edge between the first and second faces thereof, for striking top and bottom edges of an associated opening in a frame of said display apparatus, respectively, for preventing said display element from rotating more than 90 degrees in either direction.

* * * * *